US005139912A

United States Patent [19]

Aizawa

[11] Patent Number: 5,139,912

[45] Date of Patent: Aug. 18, 1992

[54] ELECTROPHOTOGRAPHIC PHOTORECEPTOR

[75] Inventor: Kouichi Aizawa, Matsumoto, Japan

[73] Assignee: Fuji Electric Co., Ltd., Japan

[21] Appl. No.: 325,778

[22] Filed: Mar. 20, 1989

[30] Foreign Application Priority Data

Mar. 24, 1988 [JP] Japan ..... 63-70649

[51] Int. Cl.[5] ..... G03G 15/04

[52] U.S. Cl. ..... 430/67; 430/66

[58] Field of Search ..... 430/66, 67

[56] References Cited

U.S. PATENT DOCUMENTS

| | | | |
|---|---|---|---|
| 3,910,797 | 10/1975 | Beers | 524/780 X |
| 3,959,573 | 5/1976 | Eddy et al. | 428/35.8 X |
| 4,250,240 | 2/1981 | Shimada et al. . | |
| 4,390,609 | 6/1983 | Wiedemann | 430/58 |
| 4,444,862 | 4/1984 | Yagi et al. | 430/67 |
| 4,472,491 | 9/1984 | Wiedemann . | |
| 4,492,616 | 1/1985 | Plietke et al. | 430/159 X |
| 4,592,979 | 6/1986 | Saitoh et al. | 430/57 |
| 4,592,981 | 6/1986 | Saitoh et al. | 430/57 |
| 4,617,350 | 10/1986 | Maeda et al. | 525/153 |
| 4,693,951 | 9/1987 | Takasu et al. | 430/31 |
| 4,724,194 | 2/1988 | Shirai et al. . | |
| 4,871,638 | 10/1989 | Kato et al. | 430/96 |

FOREIGN PATENT DOCUMENTS

| | | | |
|---|---|---|---|
| 2334082 | 2/1977 | Fed. Rep. of Germany . | |
| 3708512 | 10/1987 | Fed. Rep. of Germany . | |
| 87159 | 5/1986 | Japan . | |
| 3043162 | 2/1988 | Japan | 430/66 |
| 0221355 | 9/1988 | Japan | 430/66 |
| 3271270 | 11/1988 | Japan | 430/66 |
| 1350476 | 4/1974 | United Kingdom . | |

*Primary Examiner*—Marion E. McCamish
*Assistant Examiner*—Stephen Crossan
*Attorney, Agent, or Firm*—Brumbaugh, Graves, Donohue & Raymond

[57] ABSTRACT

An electrophotographic photoreceptor of laminate-type comprises in sequence a conductive substrate, a carrier transport layer and carrier generation layer, both of an organic substance, and a surface protective layer. The surface protective layer exhibits greatly improved humidity resistance and comprises either a fluorine-containing acrylic graft copolymer or a urethane resin such that the layer has a pure water contact angle of at least 70 degrees.

3 Claims, 1 Drawing Sheet

ELECTROPHOTOGRAPHIC PHOTORECEPTOR

BACKGROUND OF THE INVENTION

The present invention relates to a laminate-type electrophotographic photoreceptor to be positively charged by the aid of an organic photoconductive material.

Extensive studies are currently being made on organic photoconductive substances as a photosensitive material for electrophotographic photoreceptors (referred to hereinafter as "photoreceptors"). A photosensitive material made of an organic photoconductive substance offers many advantages in flexibility, heat stability, film-forming properties, transparency, and price over the conventional photosensitive material made of an inorganic photoconductive substance such as selenium. On the other hand, organic photoconductive substances have disadvantages in that they are poor in dark resistance and sensitivity. In actual use, the advantages are enhanced and the disadvantages are eliminated by forming the sensitive layer of the photoreceptor so as to comprise two laminated layers: one for carrier generation; and the other for the retention of surface charge and for carrier transport at the time of photoreception. Each layer is made of a properly selected material suitable for the desired function. Thus the laminated layers as a whole contribute to the improvement of electrophotographic performance.

The laminate-type photoreceptor is usually formed by laminating one over the other on a conductive substrate: a carrier generation layer containing an organic substance for carrier generation, and a carrier transport layer containing an organic substance for carrier transport. A photoreceptor of this type is used to form electrophotographic images by the Carlson process. The Carlson process consists of the steps of: charging the photoreceptor by means of corona discharge in the dark and exposing the surface of the charged photoreceptor, thereby forming an electrostatic latent image of the characters or pictures of an original; developing the electrostatic latent image with a toner; transferring the developed toner image to a support such as paper; and fixing the transferred image. After the transfer of the toner image, the photoreceptor is made ready for reuse by removing the charge and residual toner.

During operation, the photoreceptor is negatively charged. A disadvantage of this is that the surface of the photoreceptor becomes highly oxidized by a large amount of ozone generated by negative corona discharge. This makes it necessary to provide the photoreceptor or apparatus with a means to prevent the deterioration by ozone.

A counterpart of the negative charging system is the positive charging system which offers many advantages over the former. For example, it permits stable corona discharge, generates a smaller amount of ozone, and can be run with an easily manufactured developer. Unfortunately, any photoreceptor of laminate structure (comprising a conductive substrate, carrier generation layer, and carrier transport layer) suitable for the positive charging system is not yet available because there have not been found any organic carrier generation substance or organic carrier transport substance adequate for the layers of a photoreceptor of this type.

A possible way for the photoreceptor to be used with positive charging is to form a single layer from a mixture of a carrier generation substance and carrier transport substance or to form a carrier generation layer on a carrier transport layer. A disadvantage of the former is that the resulting single layer has a low capacity for carrier reception and lacks durability for repeated use. A disadvantage of the latter is that it is difficult to form the carrier generation layer thinner than 1 μm, preferably thinner than 0.3 μm, without deteriorating the carrier transport layer which has already been formed on the substrate. In addition, the conventional photoreceptor composed of organic layers is not as durable as the photoreceptor of selenium.

To improve the durability of the photoreceptor, there has been proposed a surface protective layer having good abrasion resistance and transparency, which is formed on the carrier generation layer. Such a surface protective layer has a disadvantage of causing streaky images at high temperatures under high humidity. To overcome this disadvantage, there has been proposed a surface protective layer of an amorphous inorganic material to be formed on the photoconductive layer of amorphous silicon, as disclosed in Japanese Patent Laid-open No. 87159/1986. According to the disclosure, the surface protective layer improves the moisture resistance and corona resistance of the photoreceptor and extends the life of the photoreceptor. Such a surface layer is characterized in that the contact angle of pure water is 40 to 70 degrees.

SUMMARY OF THE INVENTION

To achieve the above-mentioned object of the present invention, there is provided an electrophotographic photoreceptor comprising in sequence:

(a) a conductive substrate, (b) a carrier transport layer made of an organic substance, (c) a carrier generation layer made of an organic substance, and (d) a surface protective layer wherein the surface protective layer is such that it has a contact angle of at least 70 degrees, measured in the air for pure water placed on the surface thereof.

The surface protective layer having a specific surface characterized by the large contact angle of water prevents the water adsorption which would otherwise permit carriers to move along the surface, and thus prevents streaky images that might result.

DETAILED DESCRIPTION OF THE INVENTION

Figure 1:
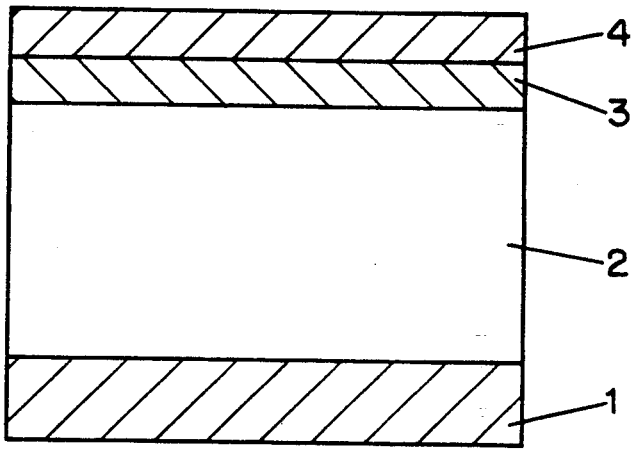
FIG. 1 is a sectional view showing the photoreceptor according to the present invention.

A photoreceptor embodying the present invention has a cross-sectional structure shown in FIG. 1, and comprises a conductive substrate 1, a carrier transport layer 2, a carrier generation layer 3, and a surface protective layer 4.

The conductive substrate 1 functions both as an electrode of the photoreceptor and as a support for the three layers 2, 3, 4 laminated thereon. The substrate 1 may be in the form of a cylinder, plate, or film, and may be made of a metal such as aluminum, stainless steel, or nickel, or glass or resin with conductive treatment.

The carrier transport layer 2 is formed from a coating material composed of a resin binder and an organic carrier transport substance dispersed therein. It is an insulation layer which retains the carriers of the photoreceptor in the dark and also transfers the carriers injected from the carrier generation layer at the time of light reception. The organic carrier transport substance may include derivatives of pyrazoline, hydrazone, triphenylmethane, or oxadiazole. The resin binder may include polycarbonate, polyester, polyamide, polyurethane, epoxy resin, silicone resin, and a polymer or copolymer of methacrylate ester. The binder material should have good mechanical chemical, and electrical stability, good adhesion properties, and good miscibility with the carrier transport substance.

The carrier generation layer 3 is formed from a photoconductive organic substance by vacuum deposition. Alternatively, it may be formed from a coating material composed of a resin binder and a photoconductive organic substance in particulate form dispersed therein. The carrier generation layer 3 acts to generate carriers upon light reception. It should have a high efficiency of carrier generation and also an ability to effectively inject the carrier into the carrier transport layer 2 and the surface protective layer 4. It should be minimally dependent on the strength of the electric field so that it is capable of injection even in a low electric field. The carrier generation substance includes phthalocyanine compounds (such as metal-free phthalocyanine or titanyl phthalocyanine), azo pigments, quinone pigments, and indigo pigments. Their selection should be made according to the wavelength of the light source used for exposure to make an image. The carrier generation layer 3 should generally have a thickness of less than 5 μm, preferably less than 1 μm. The appropriate thickness is determined by the coefficient of light absorption of the carrier generation substance at the wavelength used in the device. The carrier generation layer 3 may also be formed from a carrier generation substance as a major component and a carrier transport substance as a minor component.

The surface protective layer 4 is formed on the carrier generation layer 3 in order to improve the durability of the photoreceptor. It protects the lower layers from mechanical rubbing encountered during cleaning and also receives and retains the carrier of corona discharge in the dark. In addition, it transmits light to the carrier generation layer 3 at the time of exposure, so that the surface charge becomes extinct upon injection of the thus generated carrier.

The invention will be described in more detail with reference to the following examples.

EXAMPLE 1

The carrier transport layer 2 was formed on an aluminum cylinder by dipping in a coating material composed of two solutions: one prepared by dissolving in 700 parts by weight of tetrahydrofuran (THF) 100 parts by weight of 1- phenyl-3-(p-diethylaminostyryl)-5-(p-diethylaminophenyl)-2-pyrazoline as a carrier transport organic substance, and the other prepared by dissolving in 700 parts by weight of toluene 100 parts by weight of polymethyl methacrylate. The coating thickness after drying was 15 μm. On the carrier transport layer 2 the carrier generation layer 3 was formed by dipping in a coating material prepared by mixing 50 parts by weight of copper-phthalocyanine (maximum light absorption at 600–700 nm) and 100 parts by weight of polyester resin in THF for 3 hours using a mixing machine. The coating thickness after drying was 1 μm.

The surface protective layer 4 was formed on the carrier generation layer 3 by application from a coating solution prepared by dissolving in 100 parts by weight of methyl ethyl ketone 10 parts by weight of fluorine-containing acrylic graft copolymer ("Comb-type polymer LF-40" made by Soken Kagaku Co., Ltd.). The coating thickness after drying was 0.5 μm.

Figure 2:
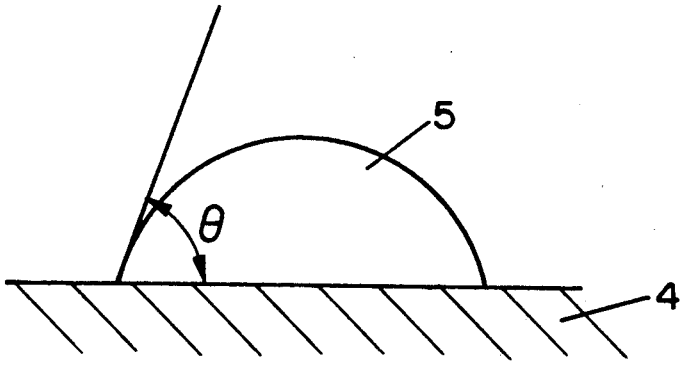
FIG. 2 is a schematic representation showing the contact angle formed by pure water on the surface protective layer.

The surface protective layer 4 was found to have a contact angle ($\theta$) of 112 degrees for water 5 as shown in FIG. 2. An actual duplicating machine provided with the photoreceptor gave a very clear image in test run in a high-temperature, high-humidity atmosphere (35° C. and 85%RH).

For comparison, a photoreceptor was produced in the same manner as mentioned above except that the surface protective layer 4 (0.5 μm thick) was prepared from tetraethyl silicate. The surface protective layer was found to have a contact angle of 40 degrees. An actual duplicating machine provided with the comparative photoreceptor gave a streaky image in test run in a high-temperature, high humidity atmosphere (35° C. and 85%RH).

EXAMPLE 2

The same procedure as in Example 1 was repeated except that the surface protective layer 4 was formed from a urethane resin. The surface protective layer was found to have a contact angle of 79 degrees. The photoreceptor produced a good image in a high-temperature, high-humidity atmosphere.

EXAMPLE 3

The same procedure as in Example 1 was repeated except that the surface protective layer 4 was formed from a mixture of tetraethyl silicate (as used for comparison) and a urethane resin (as used in Example 2), in the ratio shown in Table 1. The contact angle of the surface protective layer was measured and the image-forming test was run in a high-temperature, high-humidity atmosphere. The results are shown in Table 1.

TABLE 1

| | | | | | | |
|---|---|---|---|---|---|---|
| Tetraethyl silicate (parts by weight) | 0 | 25 | 50 | 54 | 75 | 100 |
| Urethane resin (parts by weight) | 100 | 75 | 50 | 46 | 25 | 0 |
| Contact angle $\theta$ (degrees) | 79 | 75 | 70 | 64 | 51 | 40 |
| Evaluation of image | Good | Good | Fair | Poor | Bad | Bad |

EXAMPLE 4

The same procedure as in Example 1 was repeated except that the surface protective layer 4 was formed from a mixture of a fluorine-containing acrylic graft copolymer (as used in Example 2) and tetraethyl silicate (as used for comparison), in the ratio shown in Table 2. The contact angle of the surface protective layer was measured and the image-forming test was run in a high-temperature, high-humidity atmosphere. The results are shown in Table 2.

TABLE 2

| | | | | | | |
|---|---|---|---|---|---|---|
| Tetraethyl silicate (parts by weight) | 0 | 50 | 80 | 85 | 90 | 100 |
| Fluorine-containing acrylic copolymer (parts by weight) | 100 | 50 | 20 | 15 | 10 | 0 |

TABLE 2-continued

| | | | | | | |
|---|---|---|---|---|---|---|
| Contact angle $\theta$ (degrees) | 110 | 110 | 100 | 75 | 65 | 40 |
| Evaluation of image | Good | Good | Good | Fair | Poor | Bad |

It is noted from the above-mentioned Examples 1 to 4 that the photoreceptor provides sharp images in a high temperature, high-humidity environment if the surface protective layer has a contact angle $\theta$ of 70 degrees or above. It is noteworthy that a contact angle greater than 70 degrees was obtained in Example 4 with the mixture containing only 15% of fluorine-containing resin. Presumably, this is because the fluorine-containing resin has such a strong C-F bond that it prevents the adsorption of water or the bonding with OH groups. This result suggests that the larger the content of fluoroplastics, the more desirable the photoreceptor is for moisture resistance.

I claim:

1. An electrophotographic photoreceptor comprising in sequence:
   (a) a conductive substrate,
   (b) a carrier transport layer composed of organic substances,
   (c) a carrier generation layer composed of organic substances, and
   (d) a surface protective layer comprising fluorine-containing acrylic graft copolymer wherein the surface protective layer has a pure water contact angle of at least 70 degrees.

2. The photoreceptor of claim 1, wherein the surface protective layer further comprises tetraethyl silicate.

3. The photoreceptor of claim 2, wherein the fluorine-containing acrylic graft copolymer is present in at least 15% by weight.

* * * * *